United States Patent [19]
Morcom
[11] 4,210,241
[45] Jul. 1, 1980

[54] COLLAPSIBLE ARTICLE CARRIER

[76] Inventor: Paul J. Morcom, Rte. 3, P.O. Box 224-17B, Troup, Tex. 75789

[21] Appl. No.: 923,392

[22] Filed: Jul. 10, 1978

[51] Int. Cl.[2] ..... B65D 5/36; B65D 5/46; B65D 5/48

[52] U.S. Cl. ..... 206/172; 206/182; 206/183; 206/184; 229/30; 229/41 B

[58] Field of Search ..... 206/167-171, 206/172-191; 229/30, 32, 41 B

[56] References Cited

U.S. PATENT DOCUMENTS

| | | | |
|---|---|---|---|
| 2,217,028 | 10/1940 | Powell | 206/167 X |
| 2,284,682 | 6/1912 | Powell | 206/176 X |
| 2,418,350 | 4/1947 | Holy | 206/176 |
| 2,575,654 | 11/1951 | Casler | 206/183 |
| 2,606,711 | 8/1952 | Forrer | 206/184 |
| 2,652,968 | 9/1953 | Bolding | 206/190 X |
| 2,967,641 | 1/1961 | Versack | 206/171 X |
| 3,039,651 | 6/1962 | Lang | 206/172 |
| 3,039,670 | 6/1962 | Hardon | 229/41 B X |
| 3,040,961 | 6/1962 | Meyers | 229/30 X |
| 3,063,595 | 11/1962 | Smith et al. | 206/174 |
| 3,128,906 | 4/1964 | Forrer | 206/172 |
| 3,190,487 | 6/1965 | Wood | 206/171 |
| 3,193,176 | 7/1965 | Gullickson | 229/41 B |
| 3,253,765 | 5/1966 | Train | 229/23 |
| 3,349,957 | 10/1967 | Wood | 206/172 |
| 3,359,873 | 12/1967 | Carle et al. | 206/203 |
| 3,365,098 | 1/1968 | Sims | 206/183 |
| 3,402,849 | 9/1968 | Matthews et al. | 206/176 |
| 3,421,684 | 1/1969 | Stout, Sr. et al. | 229/52 |
| 3,465,913 | 9/1969 | Zorn et al. | 206/172 |
| 3,554,401 | 1/1971 | Wood | 206/171 |
| 3,572,542 | 3/1971 | Wood | 229/52 |
| 3,587,915 | 6/1971 | Theobald | 206/203 |
| 3,589,553 | 6/1971 | Culver | 206/171 |
| 3,599,520 | 8/1971 | Wood | 23/32 |
| 3,625,393 | 12/1971 | Mittel | 206/173 |
| 3,661,297 | 5/1972 | Wood | 206/173 |
| 3,669,306 | 6/1972 | Forrer | 206/171 |
| 3,672,539 | 6/1972 | Forrer | 206/172 |
| 3,754,680 | 8/1973 | Wood | 229/52 BC |
| 3,815,732 | 6/1974 | Klygis | 206/183 |
| 4,029,205 | 6/1977 | Wood | 206/173 |
| 4,032,007 | 6/1977 | Graser et al. | 206/173 |

FOREIGN PATENT DOCUMENTS 521966 2/1956 Canada .

*Primary Examiner*—Stephen P. Garbe
*Attorney, Agent, or Firm*—Richards, Harris & Medlock

[57] ABSTRACT

The specification discloses a collapsible article carrier formed from a folded sheet of material that is alternatively foldable into a substantially flat, collapsed position and an open position for receiving articles. The article carrier includes a bottom member having first and second bottom panels. First and second side walls are hingedly joined along bottom edges thereof to edges of the first and second bottom panels. First and second end panels are hingedly joined to edges of the first side wall, and third and fourth end panels are hingedly joined to edges of the second side wall. The first and third end panels are hingedly joined to form a first end wall. The second and fourth end panels are hingedly joined to form a second end wall. The end panels include a fold line having a predetermined angle with respect to the bottom edge of the end panels to permit the first and third end panels to lie coincident with one another and to permit the second and fourth end panels to lie coincident with one another when the collapsible article carrier is in the collapsed position. First and second tab members are formed from first and second cutouts contained within the first bottom panel for hingedly joining the first and second end panels to the first bottom panel. Third and fourth tab members are formed from third and fourth cutouts contained within the second bottom panel for hingedly joining the third and fourth end panels to the second bottom panel. The bottom member is foldable to fold upwardly and inwardly between the side walls to thereby permit either one of the end walls to fold inwardly between the side walls in the collapsible article carrier collapsed position.

27 Claims, 8 Drawing Figures

COLLAPSIBLE ARTICLE CARRIER

FIELD OF THE INVENTION

This invention relates to article carriers, and more particularly relates to a collapsible article carrier which may be readily collapsed and assembled for shipment or storage and for use.

PRIOR ART

Paperboard carriers are commonly used for packaging and transporting glass and plastic beverage bottles. A typical paperboard article carrier is described in U.S. Pat. No. 3,128,906 issued Apr. 14, 1964, wherein several paper panels are foldably joined and affixed using glue. The gluing operation, requiring numerous glue joints and expensive machinery, and the substantial amount of paperboard to assure a structurally sound article carrier, results in a manufacturing process and product that is quite costly. Because of this cost, users of article carriers traditionally reuse carriers in the cycle from beverage manufacturer to consumer and back to beverage manufacturer. The reuse results in the deterioration of the paperboard carrier. Further, if the article carrier becomes wet with moisture, the paperboard carrier may become structurally unsound and unusable.

Although substitution of plastic material for paperboard has minimized several problems in prior article carriers, folded thickness and the ease in which plastic article carriers may be folded continue to present a problem for shippers and the consumer. A plastic carrier is described in U.S. Pat. No. 3,039,651 issued June 19, 1962 to Robert Lang, and entitled "Collapsible Molded Plastic Carton". However, such prior molded plastic cartons have not been completely satisfactory in ease and economy of manufacture, nor with respect to ease of opening and folding for stacking.

A need has thus arisen for a collapsible article carrier that is readily foldable to a substantially flat collapsed position and which is structurally sound to carry heavy beverage bottles or cans. A need has further arisen for an article carrier that is inexpensive to manufacture avoiding the use of complicated interlocking connections or extensive use of adhesives to produce an inexpensive article carrier yet maintain high quality standards. Such an article carrier must also minimize the amount of material necessary to produce the article carrier.

SUMMARY OF THE INVENTION

The present invention is directed to a collapsible article carrier which substantially eliminates or reduces the disadvantages associated with prior art article carriers. The present article carrier can be economically manufactured to form a structurally sound, lightweight article carrier that is readily foldable and collapsible for ease in storage and transportation and which can be used for longer periods of time than the article carriers associated with the prior art.

In accordance with the present invention, a collapsible article carrier is formed from a folded sheet of material that is alternatively foldable into a substantially flat collapsed position and an open position for receiving articles. The article carrier includes a unitary bottom member having first and second bottom panels. The first and second bottom panels are hingedly joined along a central horizontal fold line. First and second side walls are hingedly joined along bottom edges thereof to edges of the first and second bottom panels. First and second end panels are hingedly joined to edges of the first side wall, and third and fourth end panels are hingedly joined to edges of the second side wall. The first and third end panels are hingedly joined to form a first end wall. The second and fourth end panels are hingedly joined to form a second end wall. The end panels include a fold line having a predetermined angle with respect to the bottom edge of the panels to permit the first and third end panels to lie coincident with one another and to permit the second and fourth end panels to lie coincident with one another when the collapsible article carrier is in the collapsed position. First and second tab members are formed from first and second cutouts contained within the first bottom panel for hingedly joining the first and second end panels to the first bottom panel. Third and fourth tab members are formed from third and fourth cutouts contained within the second bottom panel for hingedly joining the third and fourth end panels to the second bottom panel. The bottom member is foldable along the central horizontal fold line to fold upwardly and inwardly between the side walls in the collapsible article carrier collapsed position to thereby permit either one of the end walls to fold inwardly between the side walls, to thereby permit the side walls to lie coincident with one another in the collapsible article carrier collapsed position, such that the collapsible article carrier may be folded about the hinged panels and walls to a substantially flat collapsed position and folded to the open position for receiving articles.

In accordance with another aspect of the present invention, a collapsible article carrier is formed from a folded sheet of material that is alternatively foldable into a substantially flat collapsed position and an open position for receiving articles. The article carrier includes a unitary bottom member having first and second bottom panels. The first and second bottom panels are hingedly joined along a central horizontal fold line to form a centrally disposed wall foldably joined to the first and second bottom panels along the central horizontal fold line. First and second side walls are hingedly joined along bottom edges thereof to edges of the first and second bottom panels. First and second end panels are hingedly joined to edges of the first side wall. Third and fourth end panels are hingedly joined to edges of the second side wall. The first and third end panels are hingedly joined to form a first end wall, and the second and fourth end panels are hingedly joined to form a second end wall. The end panels include first and second fold lines having predetermined angles with respect to the bottom edge of the end panels to permit the first and third end panels to lie coincident with one another and to permit the second and fourth end panels to lie coincident with one another when the collapsible article carrier is in the collapsed position. First and second tab members are formed from first and second cutouts contained within the first bottom panel for hingedly joining the first and second end panels to the first bottom panel. Third and fourth tab members are formed from third and fourth cutouts contained within the second bottom panel for hingedly joining the third and fourth end panels to the second bottom panel. The collapsible article carrier further includes first and second dividing walls hingedly joined to the first and second side walls to form a plurality of receiving cellular compartments between the first and second side walls within the collapsible article carrier. The first and second dividing walls include a centrally disposed vertical fold line, such that the first and second dividing walls lie parallel to the first and second side walls in the collapsible article carrier collapsed position. A handle member is hingedly joined to the first and second end walls and includes structure for partitioning the plurality of receiving cellular compartments. The bottom member is foldable along the central horizontal fold line to fold upwardly and inwardly between the side walls in the collapsible article carrier collapsed position to thereby permit either one of the end walls to fold inwardly between the side walls, to thereby permit the side walls to lie coincident with one another in the collapsible article carrier collapsed position, such that the collapsible article carrier may be folded about the hinged panels and walls to a substantially flat collapsed position and unfolded to the open position for receiving articles.

DESCRIPTION OF THE DRAWINGS

For a more complete understanding of the present invention and further advantages thereof, reference is now made to the following description, taken in conjunction with the accompanying drawings, in which.

DESCRIPTION OF THE PREFERRED EMBODIMENT

Figure 1:
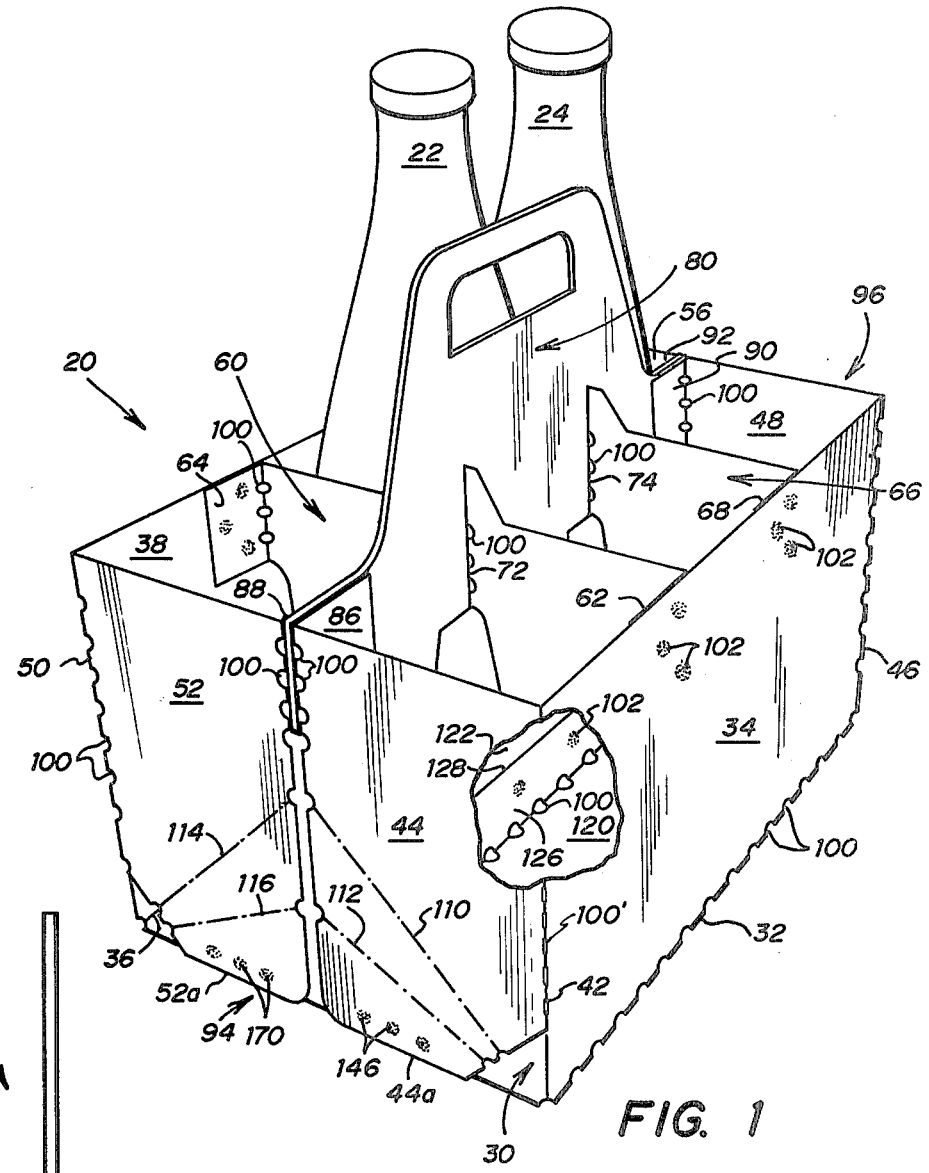
FIG. 1 is a perspective view, partially broken away, of the collapsible article carrier of the present invention in the open position.

FIG. 1 illustrates the present collapsible article carrier which is generally identified by the numeral 20. The collapsible article carrier 20 is shown in the open position with glass beverage bottles 22 and 24 received by two of the receiving cellular compartments defined within collapsible article carrier 20. Collapsible article carrier 20 includes a unitary bottom member generally identified by the numeral 30. Hingedly joined along an edge 32 of unitary bottom member 30 is a first side wall 34 which is hingedly joined along the entire length of collapsible article carrier 20. Similarly, hingedly joined along an edge 36 of unitary bottom member 30 is a second side wall 38 of collapsible article carrier 20. First side wall 34 and second side wall 38 lie parallel to each other when the collapsible article carrier 20 is in the open position as illustrated in FIG. 1.

Hingedly joined along a vertical edge 42 of first side wall 34 is a first end panel 44. Hingedly joined along a vertical edge 46 of first side wall 34 is a second end panel 48. First and second end panels 44 and 48 of collapsible article carrier 20 lie perpendicularly to first side wall 34 and parallel to one another in the open position of collapsible article carrier 20.

Hingedly joined to a vertical edge 50 of second side wall 38 is a third end panel 52 of collapsible article carrier 20. Hingedly joined along a vertical edge 54 (FIG. 2) of second side wall 38 is a fourth end panel 56 of collapsible article carrier 20. Fourth end panel 56 lies parallel to third end panel 52 when collapsible article carrier 20 is in the open position as illustrated in FIG. 1. Third and fourth end panels 52 and 56 lie perpendicularly to second side wall 38 and parallel to one another in the open position of collapsible article carrier 20.

Figure 5:
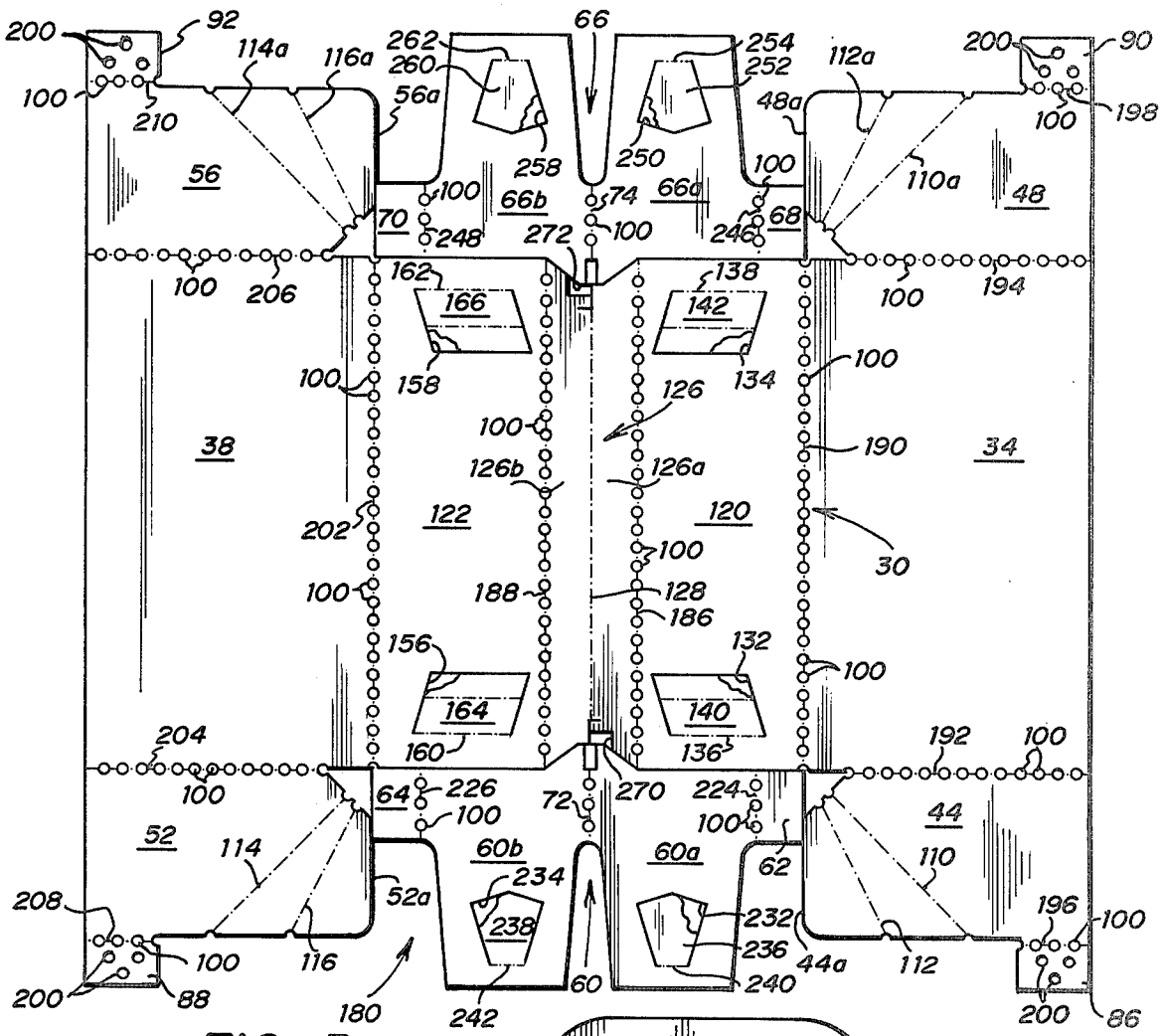
FIG. 5 is a plan view of the blank from which the collapsible article carrier of FIG. 1 is formed.

Collapsible article carrier 20 further includes a first dividing wall generally identified by the numeral 60 hingedly joined to first and second side walls 34 and 38 using tab members 62 and 64. A second dividing wall generally identified by the numeral 66 is hingedly joined to first and second side walls 34 and 38 utilizing tab members 68 and 70 (FIG. 5). First and second dividing walls 60 and 66 include centrally disposed vertical hinges 72 and 74 which permit first and second dividing walls 60 and 66 to collapse when collapsible article carrier 20 is folded to the collapsed position as will subsequently be described.

Collapsible article carrier 20 further includes a handle member generally identified by the numeral 80 which is centrally disposed within collapsible article carrier 20 and perpendicularly disposed to first and second dividing walls 60 and 66. Handle member 80 together with first and second dividing walls 60 and 66 divide collapsible article carrier 20 into a plurality of receiving cellular compartments for receiving articles such as beverage bottles 22 and 24. While only six receiving cellular compartments are illustrated in FIG. 1, collapsible article carrier 20 can be provided with any desired number of receiving cellular compartments by adding or deleting dividing walls, such as first and second dividing walls 60 and 66.

First end panel 44 and third end panel 52 are hingedly joined to handle member 80 utilizing tab members 86 and 88. Similarly, second end panel 48 and fourth end panel 56 are hingedly joined to handle member 80 utilizing tab members 90 and 92. For ease in identification, the resulting end wall of collapsible article carrier 20 formed by first end panel 44 and third end panel 52 will be generally identified by the numeral 94 and will be referred to as the first end wall. The resulting end wall formed by second end panel 48 and fourth end panel 56 will be generally identified by the numeral 96 and will be referred to as the second end wall. First and second end walls 94 and 96 lie parallel to one another and perpendicularly to first and second side walls 34 and 38 of collapsible article carrier 20. It therefore can be seen that collapsible article carrier 20 includes unitary bottom member 30, first and second side walls 34 and 38 and first and second end walls 94 and 96. The edges which hingedly join walls 34, 38, 94 and 96 are perforated including a plurality of apertures identified by the numeral 100 shown along vertical edges 42 and 50. Apertures 100 function to increase the foldability of the hinges of collapsible article carrier 20 as well as increasing the aesthetic appeal of collapsible article carrier 20. Although apertures 100 have been illustrated as being substantially circular in shape, apertures 100 can also be rectangular or slotted in shape as illustrated along edge 42 and identified by numeral 100'.

In the preferred embodiment, collapsible article carrier 20 is formed from a sheet of extruded plastic such as a sheet of polyethylene material which is capable of heat sealing or ultrasonic welding. In the preferred embodiment, the walls and tab members of collapsible article carrier 20 are ultrasonically welded to form the hinged joints of collapsible article carrier 20 to allow collapsible article carrier 20 to be alternately folded to the collapsed position and to the open position as illustrated in FIG. 1. The symbol "⊕" identified in FIG. 1 by the numeral 102 will be utilized to designate a location on collapsible article carrier 20 in which an ultrasonic spot weld is generated to bond various portions of collapsible article carrier 20.

Figure 2:
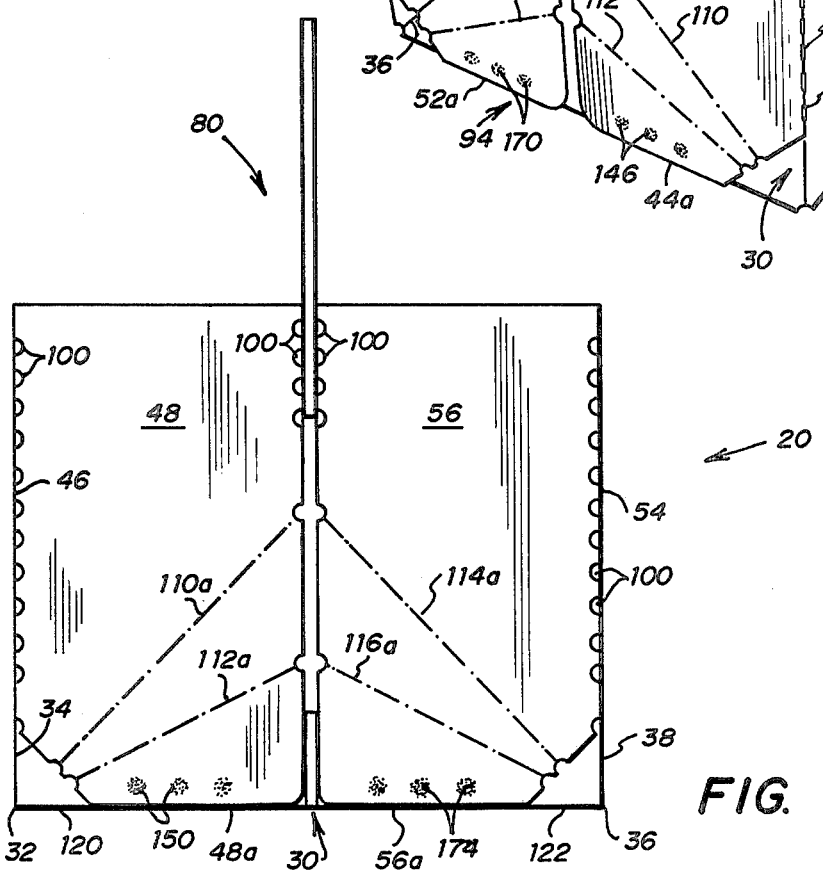
FIG. 2 is an end view of the collapsible article carrier in the open position shown in FIG. 1.

Referring simultaneously to FIGS. 1 and 2, first end panel 44 includes a fold line 110 and a fold line 112. Fold line 110 in the preferred embodiment is disposed at a predetermined angle of approximately 45° with respect to bottom edge 44*a* of first end panel 44. Fold line 112 in the preferred embodiment is disposed at a predetermined angle of approximately 22.5° with respect to bottom edge 44*a* of first end panel 44. Third end panel 52 includes fold lines 114 and 116. Fold lines 114 and 116 in the preferred embodiment are disposed at approximately 45° and 22.5° with respect to bottom edge 52*a* of third end panel 52. Similarly disposed on second end panel 48 and fourth end panel 56 are fold lines 110*a*, 112*a*, 114*a* and 116*a* (FIG. 2). Fold lines 110, 112, 114, 116, 110*a*, 112*a*, 114*a* and 116*a* enable collapsible article carrier 20 to fold to the substantially flat collapsed position as will subsequently be described.

Figure 3:
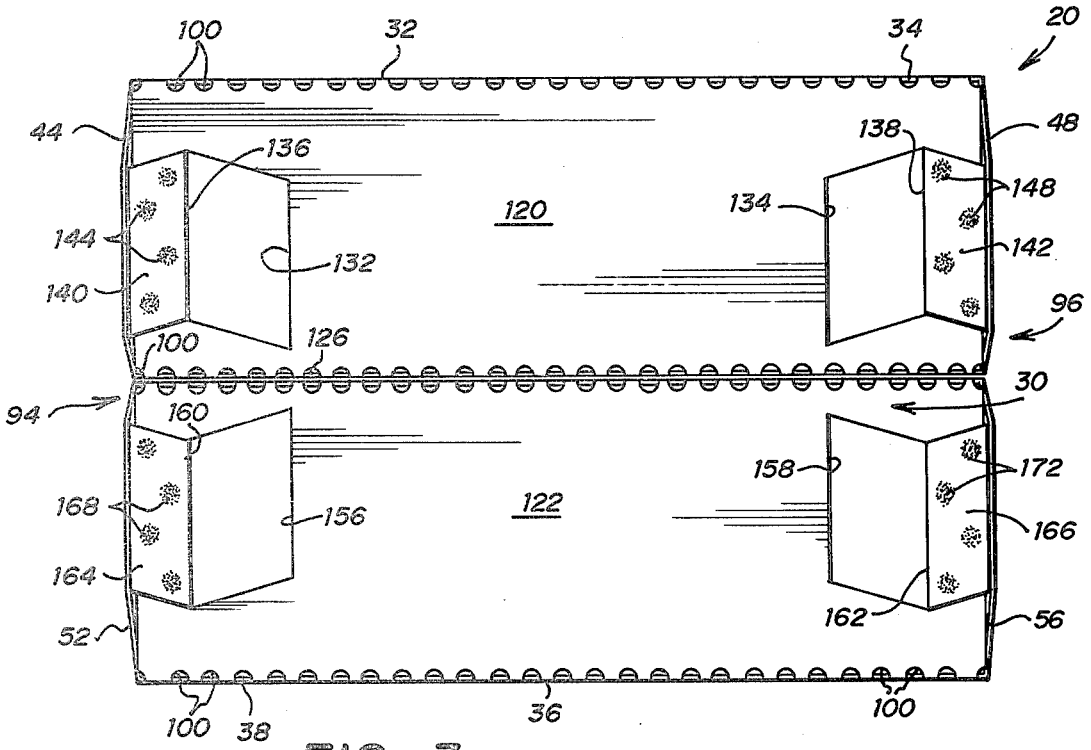
FIG. 3 is a bottom plan view of the collapsible article carrier in the open position shown in FIG. 1.

Referring simultaneously to FIGS. 1 and 3, unitary bottom member 30 of collapsible article carrier 20 includes first and second bottom panels 120 and 122. First and second bottom panels 120 and 122 are hingedly joined to form a central wall 126. Central wall 126 extends along the entire length of collapsible article carrier 20 and functions as a partition and spacer between articles received by the plurality of receiving cellular compartments of collapsible article carrier 20. Central wall 126 terminates in a central horizontal fold line 128 and is coplanar with handle member 80.

First bottom panel 120 includes cutout apertures 132 and 134. The material of first bottom panel 120 which forms cutouts 132 and 134 is not completely removed from first bottom panel 120 but is retained along fold lines 136 and 138 to form tab members 140 and 142. Tab member 140 is folded to hingedly join first bottom panel 120 to first end panel 44 of first end wall 94. Tab member 140 in the preferred embodiment is ultrasonically welded at weld locations 144 along first bottom panel 120 and weld locations 146 along first end panel 44 (FIG. 1). Similarly, tab member 142 is folded to hingedly join first bottom panel 120 to second end panel 48 of second end wall 96. In the preferred embodiment tab member 142 is ultrasonically welded to first bottom panel 120 at weld locations 148 and is ultrasonically welded at weld locations 150 (FIG. 2) to second end panel 48.

Second bottom panel 122 is structured similar to first end panel 120 and includes cutout apertures 156 and 158. The material of second bottom panel 122 is not completely removed from cutouts 156 and 158 but is folded along fold lines 160 and 162 to form tab members 164 and 166. Tab member 164 is folded to hingedly join second bottom panel 122 to third end panel 52 of first end wall 94 of collapsible article carrier 20. Similarly, tab member 166 is folded to hingedly join second bottom panel 122 to fourth end panel 56 of second end wall 96. In the preferred embodiment, tab member 164 is ultrasonically welded at weld locations 168 to second bottom panel 122 and at weld locations 170 (FIG. 1) to third end panel 52. Tab member 166 is ultrasonically welded to second bottom panel 122 and to fourth end panel 56 at weld locations 172 and 174 (FIG. 2).

Figure 4:
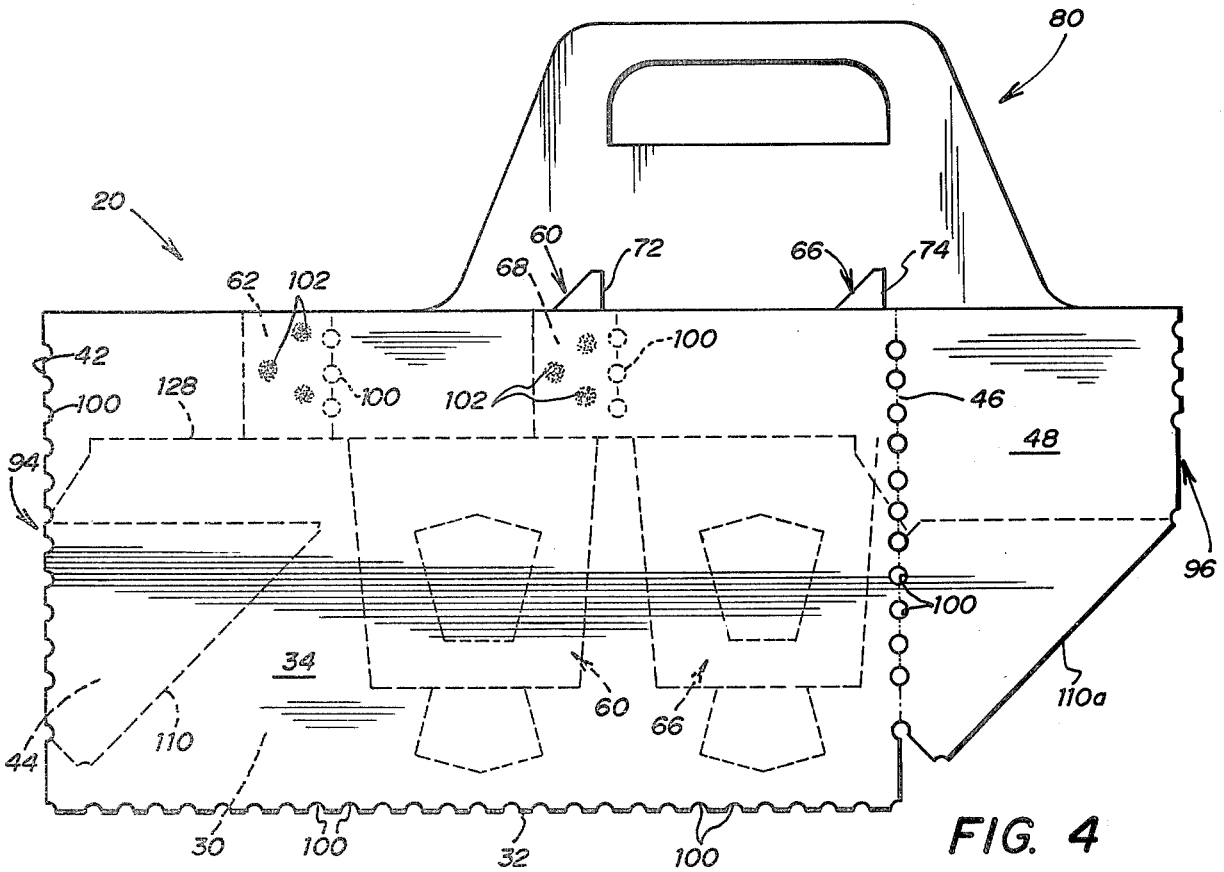
FIG. 4 is a side elevational view of the collapsible article carrier shown in FIG. 1 in the collapsed position.

FIG. 4 illustrates the folded and collapsed position of collapsible article carrier 20. In the collapsed position, collapsible article carrier 20 is folded to a substantially flat position for storage and transportion when not in use. In the collapsed position, unitary bottom member 30 folds along central horizontal fold line 128 and along the edges of attachment 32 and 36 to first and second side walls 34 and 38 to fold upwardly and inwardly between first and second side walls 34 and 38. First end wall 94 folds inwardly to be disposed between first and second side walls 34 and 38 while second end wall 96 folds outwardly of first and second side walls 34 and 38 in the collapsed position. More specifically, first and third end panels 44 and 52 of first end wall 94 fold along fold lines 110 and 114 to permit unitary bottom member 30 to lie interposed between first and third end panels 44 and 52. Second and fourth end panels 48 and 56 fold along fold lines 110*a* and 114*a* and extend outwardly of first and second side walls 34 and 38 of collapsible article carrier 20. An important aspect of the present invention is that since collapsible article carrier 20 is completely symmetrical, collapsible article carrier 20 can be folded in the opposite direction from that illustrated in FIG. 4. Therefore, first end wall 94 can also be folded such that first and third end panels 44 and 52 extend outwardly of first and second side walls 34 and 38 while second end wall 96 comprising second and fourth end panels 48 and 56 lie interposed between first and second side walls 34 and 38. It therefore can be seen that in the collapsed position of collapsible article carrier 20 first and second side walls 34 and 38 lie coincident with one another, first and third end panels 44 and 52 lie coincident with one another and second and fourth end panels 48 and 56 lie coincident with one another. In this folded configuration, handle member 80 would be assembled to collapsible article carrier 20 in the reverse position as will be subsequently be described.

FIG. 4 also illustrates the position of first and second dividing walls 60 and 66. First and second dividing walls 60 and 66 fold along vertical hinges 72 and 74 such that first and second dividing walls 60 and 66 lie parallel to first and second side walls 34 and 38. Although FIG. 4 illustrates the folding of first and second end walls 94 and 96 along fold lines 110 and 114, in the alternative, first and second end walls 94 and 96 may also be folded along fold lines 112 and 116.

Referring to FIG. 5, the blank generally identified by the numeral 180 used to form unitary bottom member 30, first and second side walls 34 and 38, first and second end walls 94 and 96 and first and second dividing walls 60 and 66 of collapsible article carrier 20 is illustrated. Like numerals are utilized for like and corresponding elements previously identified. Blank 180 is preferably formed from a flat extruded sheet of polyethylene or polypropylene material. The thickness of the sheet can be varied, so long as the sheet maintains a flexible character. The collapsible article carrier 20 can also be formed from conventional flexible paperboard material if desired. The blank 180 can be readily cut, scored or creased using conventional knives, rolls and other devices generally used for such purposes. In addition, the hinges and fold lines can be formed by utilizing a combination of heat and pressure to form living hinges in which the sheet of material has a reduced thickness along the fold line or living hinge. Additionally, the fold lines and hinges may be formed using an ultrasonic horn bar.

It can be seen from FIG. 5 that unitary bottom member 30, first and second side walls 34 and 38, first and second end panels 44 and 48 and third and fourth end panels 52 and 56 are all integrally connected when cut from blank 180. First and second dividing walls 60 and 66 are severed from blank 180 after the cutting operation. The remaining material from blank 180 not utilized to form the above-mentioned walls and panels can be reground to injection mold handle member 80 to substantially eliminate any waste of material involved in the manufacture of collapsible article carrier 20.

FIG. 5 illustrates the fold lines and hinges formed in blank 180 necessary to construct collapsible article carrier 20. The central wall 126 is formed from wall panels 126*a* and 126*b*. Central wall panels 126*a* and 126*b* and contiguous and joined along central horizontal fold line 128. Central wall panel 126*a* is contiguous with first bottom panel 120 and is joined along hinge 186. Central wall panel 126*b* is contiguous with second bottom panel 122 and is joined along hinge 188. Hinges 186 and 188 are perforated and include apertures 100.

Contiguous with first bottom panel 120 and joined along a hinge 190 is first side wall 34. Contiguous with first side wall 34 and joined along hinges 192 and 194 are first and second end panels 44 and 48. Contiguously joined to first end panel 44 along a hinge 196 is tab member 86. Tab member 90 is contiguously joined to second end panel 48 along hinge 198. Tab members 86 and 90 include apertures 200 for receiving studs of handle member 80 for mounting handle member 80 to first and second end panels 44 and 48.

In a similar manner, second bottom panel 122 is hingedly joined to second side wall 38 along a hinge 202. Second side wall 38 is hingedly joined along hinges 204 and 206 to third and fourth end panels 52 and 56. Tab members 88 and 92 are hingedly joined and contiguous with third and fourth end panels 52 and 56 along hinges 208 and 210. Tab members 88 and 92 include apertures 200 for receiving studs of handle member 80 for mounting handle member 80 to third and fourth end panels 52 and 56.

FIG. 5 also illustrates the positioning of fold lines 110, 112, 114 and 116 of first and third end panels 44 and 52. Fold lines 110 and 114 are approximately 45° with respect to bottom edges 44*a* and 52*a* of first and third end panels 44 and 52. Fold lines 112 and 116 are approximately 22.5° with respect to bottom edges 44*a* and 52*a* of first and third end panels 44 and 52. Similarly, fold line 110*a* is approximately 45° with respect to bottom edge 48*a* of second end panel 48. Fold line 112*a* is approximately 22.5° with respect to bottom edge 48*a* of second end panel 48. Fold line 114*a* is approximately 45° with respect to bottom edge 56*a* of fourth end panel 56, and fold line 116*a* is approximately 22.5° with respect to bottom edge 56*a* of fourth end panel 56.

FIG. 5 also illustrates the configuration of first and second dividing walls 60 and 66. First dividing wall 60 includes vertical hinge 72 centrally disposed to separate first dividing wall 60 into wall sections 60*a* and 60*b*. Contiguous with wall section 60*a* is tab member 62 hingedly joined along hinge 224. Contiguous with wall section 60*b* is tab member 64 hingedly joined along hinge 226. Wall sections 60*a* and 60*b* also include cutout apertures 232 and 234 to form extension tab members 236 and 238. Extension tab member 236 is folded along fold line 240 to extend the overall length of wall section 60*a* and functions as a partition between articles received within receiving cellular compartments of collapsible article carrier 20. Extension tab member 238 of wall section 60*b* similarly folds along a fold line 242 to increase the overall length of wall section 60*b*. The use of extension tab members 236 and 238 again conserves material utilized to construct collapsible article carrier 20.

Second dividing wall 66 is configured identically to first dividing wall 60 and includes vertical hinge 74 for dividing second dividing wall 66 into wall sections 66*a* and 66*b*. Tab member 68 is contiguous with wall section 66*a* and is hingedly joined along hinge 246. Tab member 70 is contiguous with wall section 66*b* and is hingedly joined along hinge 248. Wall section 66*a* includes a cutout aperture 250 to form an extension tab member 252 hinged along fold line 254 to extend the overall length of wall section 66*a*. Similarly, wall section 66*b* includes a cutout aperture 258 to form an extension tab member 260 foldable along fold line 262 to increase the overall length of wall section 66*b*.

FIG. 5 also illustrates the latch mechanism of collapsible article carrier 20. Formed within central wall panel 126*a* is a notch 270. Formed within central wall panel 126*b* is a notch 272. Notches 270 and 272 are utilized in connection with handle member 80 to lock collapsible article carrier 20 in the open position to prevent inadvertent folding of collapsible article carrier 20. The locking mechanism will be further described in connection with FIGS. 7 and 8.

Figure 6:
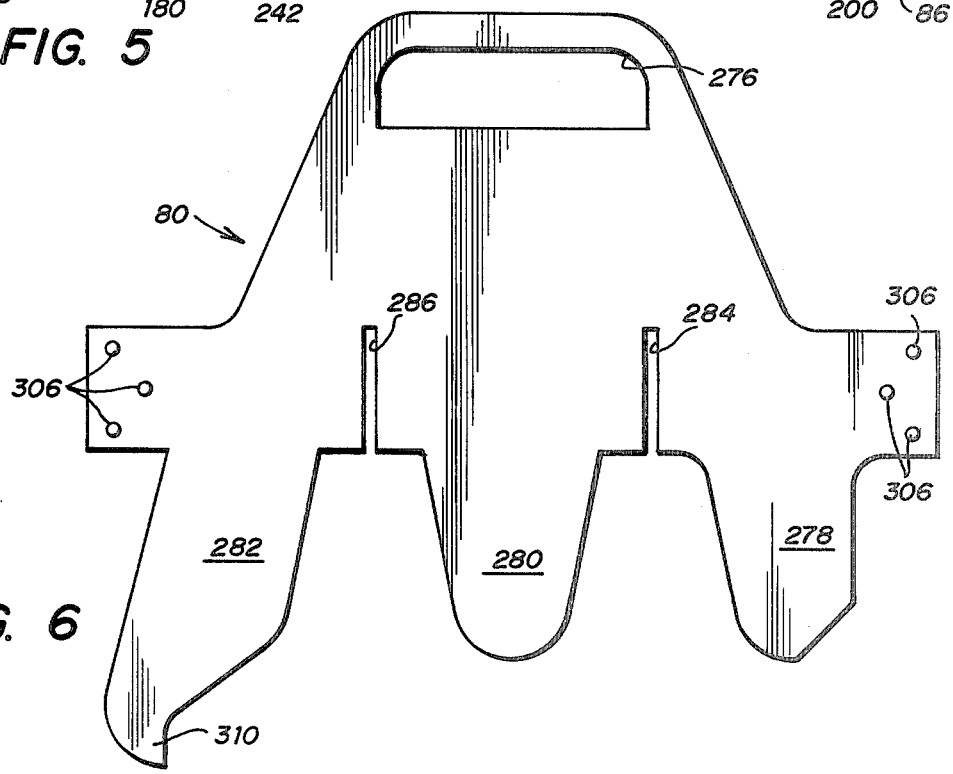
FIG. 6 is a side elevational view of the handle member of the collapsible article carrier shown in FIG. 1.

Referring to FIG. 6, handle member 80 is illustrated. Handle member 80 includes a central aperture 276 by which a user of collapsible article carrier 20 may grasp collapsible article carrier 20. Vertically displaced on handle member 80 are finger members 278, 280 and 282. Finger members 278, 280 and 282 function as partitions for centrally partitioning the receiving cellular compartments of collapsible article carrier 20. Finger members 278, 280 and 282 lie coplanar with central wall 126 formed in unitary bottom member 30 and together with central wall 126 provide a partition extending over the entire height of collapsible article carrier 20 to separate and protect the articles received by the receiving cellular compartments of collapsible article carrier 20. Finger members 278 and 280 are separated by a vertical slot 284. Finger members 280 and 282 are separated by a vertical slot 286. Vertical slots 284 and 286 receive first and second dividing walls 60 and 66 and align with vertical hinges 72 and 74 of first and second dividing walls 60 and 66.

Handle member 80 also includes studs 306 which are integrally molded into handle member 80 and project on both sides of handle member 80. Studs 306 mate with apertures 200 of tab members 86, 88, 90 and 92 of first, second, third and fourth end panels 44, 48, 52 and 56. Studs 306 are then staked by application of heat or through the use of an ultrasonic horn to melt the stud to form a head to securely attach handle member 80 to tab members 86, 88, 90 and 92 of first and second end walls 94 and 96.

Finger member 282 at its lower end includes a latch member 310. Latch member 310 is positioned to mate with either of notches 270 or 272 of central wall 126 to form the locking mechanism of collapsible article carrier 20 in the open position. The locking mechanism will be further illustrated in connection with FIGS. 7 and 8.

Figure 7:
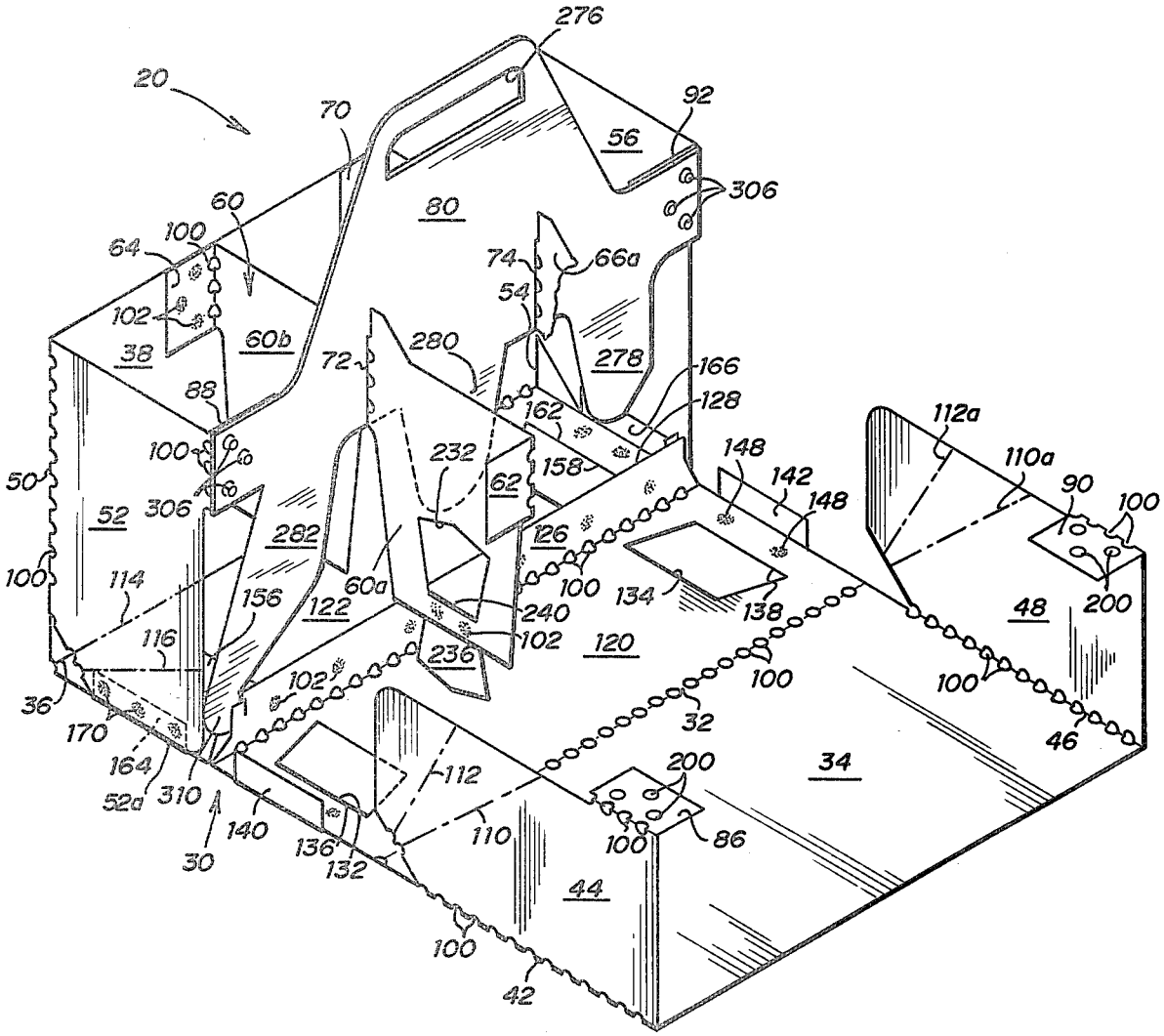
FIG. 7 is a perspective view of the collapsible article carrier of FIG. 1 shown partially assembled.

Referring now to FIG. 7, a partially constructed collapsible article carrier 20 is illustrated. After being cut from blank 180, first and second side walls 34 and 38, first, second, third and fourth end panels 44, 48, 52 and 56 and central wall 126 are folded about their associated hinges. Central wall panels 126*a* and 126*b* are hingedly joined to subdivide unitary bottom member 30 into first and second bottom panels 120 and 122. As illustrated in FIG. 7, second bottom panel 122 is next joined to third and fourth end panels 52 and 56 using tab members 164 and 166. It can be seen that tab member 164 wraps around bottom edge 52*a* of third end panel 52 and is ultrasonically welded along weld locations 170. Alternatively, tab member 164 can be ultrasonically welded on the interior side of third end panel 52 as shown in FIG. 2.

The next general step in the construction of collapsible article carrier 20 is the joining of first and second dividing walls 60 and 66 using tab members 64 and 70 to the interior surface of second side wall 38. Handle member 80 could then be inserted such that vertical slots 284 and 286 align with vertical hinges 72 and 74 of first and second dividing walls 60 and 66 such that studs 306 align with apertures 200 of tab members 88 and 92 of third and fourth end panels 52 and 56. Studs 306 would then be staked in order to bond handle member 80 to third and fourth end panels 52 and 56.

Prior to the insertion of first and second dividing walls 60 and 66 into collapsible article carrier 20, the extension tab members 236 and 238 of first dividing wall 60 and extension tab members 252 and 260 of second dividing wall 66 would be folded along their respective fold lines and welded as is illustrated in FIG. 7 with respect to extension tab member 238.

In a like manner as discussed above, first bottom panel 120 is hingedly joined to first and second end panels 44 and 48 using tab members 140 and 142. Additionally, handle member 80 is joined to tab members 86 and 90 of first and second end panels 44 and 48. It therefore can be seen that collapsible article carrier 20 can be economically and quickly manufactured.

Figure 8:
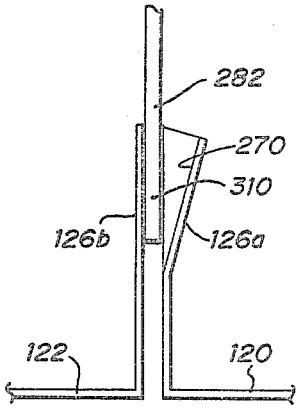
FIG. 8 is an enlarged end view of the latch mechanism of the collapsible article carrier shown in FIG. 1.

Referring simultaneously to FIGS. 7 and 8, the locking mechanism of collapsible article carrier 20 is illustrated. Since collapsible article carrier 20 is completely symmetrical, handle member 80 can be inserted into collapsible article carrier 20 in either of two positions such that latch 310 engages either notch 270 or 272 of central wall 126. When collapsible article carrier 20 is in the locked position, latch 310 engages either notch 270 or 272 between wall panels 126*a* and 126*b* of central wall 126. Latch 310 is easily insertable into notch 270 or 272 since finger member 282 is free to flex about fold line 300 of handle member 80. Collapsible article carrier 20 can be selectively locked through the positioning of finger member 282 such that latch 310 engages either notch 270 or 272.

Although the use of ultrasonic welding is described to hingedly attach the various tab members, bottom member and wall portions of collapsible article carrier 20, other attachment devices, depending upon the type of sheet material selected, can be alternatively utilized. These attachment devices include various fasteners such as staples, snaps, eyelets, riveting, sewing, heat sealing, spot or fusion welding and various adhesive materials.

It will thus be seen that the present invention provides for a collapsible article carrier that can be economically manufactured from a sheet of material. The collapsible article carrier is structurally sound, lightweight and can be folded for ease in storage and transportation. The collapsible article carrier of the present invention further includes a locking mechanism to lock the collapsible article carrier in the open position to prevent inadvertent folding. Furthermore, the collapsible article carrier of the present invention utilizes a perforated hinge to hingedly join portions of the carrier to provide for a structurally sound and aesthetically pleasing hinge.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A collapsible article carrier formed from a folded sheet of material and being alternatively foldable into a substantially flat collapsed position and an open position for receiving articles comprising:

a unitary bottom member having first and second bottom panels, said first and second bottom panels being hingedly joined along a central horizontal fold line;

first and second side walls parallel to one another and being hingedly joined along bottom edges thereof to edges of said first and second bottom panels opposite said central horizontal fold line of said unitary bottom member, such that said first and second side walls extend perpendicularly to said unitary bottom member when the collapsible article carrier is in the open position;

first and second end panels parallel to one another when the collapsible article carrier is in the open position, said first and second end panels being hingedly joined to opposite edges of said first side wall to extend perpendicularly to said first side wall when the collapsible article carrier is in the open position;

third and fourth end panels parallel to one another when the collapsible article carrier is in the open position, said third and fourth end panels being hingedly joined to opposite edges of said second side wall to extend perpendicularly to said second side wall and parallel to said first and second end panels when the collapsible article carrier is in the open position;

said first and third end panels being hingedly joined to form a first end wall;

said second and fourth end panels being hingedly joined to form a second end wall;

each of said end panels including a fold line having a predetermined angle with respect to the bottom edge of said end panels to permit said first and third end panels to lie coincident with one another and to permit said second and fourth end panels to lie coincident with one another when the collapsible article carrier is in the collapsed position;

means for attaching said unitary bottom member to said end panels including first and second tab means formed from first and second cutouts contained within said first bottom panel and means for hingedly joining said first and second tab means to said first and second end panels for securing said first bottom panel to said first and second end panels, and third and fourth tab means formed from third and fourth cutouts contained within said second bottom panel and means for hingedly joining said third and fourth tab means to said third and fourth end panels for securing said second bottom panel to said third and fourth end panels; and said bottom member being foldable along said central horizontal fold line to fold upwardly and inwardly between said side walls in the collapsible article carrier collapsed position to thereby permit either one of said end walls to fold inwardly between said side walls, to thereby permit said side walls to lie coincident with one another in the collapsible article carrier collapsed position, such that the collapsible article carrier may be folded about said hinged panels and walls to a substantially flat collapsed position and folded to the open position for receiving articles.

2. The collapsible article carrier of claim 1 and further including:

first and second dividing walls parallel to one another and perpendicularly disposed to said first and second side walls, said first and second dividing walls being hingedly joined to said first and second side walls at spaced locations between said first and second end walls to form a plurality of receiving cellular compartments between said first and second side walls within the collapsible article carrier.

3. The collapsible article carrier of claim 2 wherein said first and second dividing walls include a centrally disposed vertical fold line, such that said first and second dividing walls lie parallel to said first and second side walls in the collapsible article carrier collapsed position.

4. The collapsible article carrier of claim 2 and further including:

a handle member joined to said first and second end walls.

5. The collapsible article carrier of claim 4 wherein said unitary bottom member includes latch means for receiving said handle member to selectively lock the collapsible article carrier in the open position to thereby prevent folding of the collapsible article carrier.

6. The collapsible article carrier of claim 4 wherein said handle member further includes:

means for partitioning said plurality of receiving cellular compartments.

7. The collapsible article carrier of claim 6 wherein said means for partitioning said plurality of receiving cellular compartments extends substantially the entire height of the collapsible article carrier.

8. The collapsible article carrier of claim 1 wherein said sheet of material comprises a heat sealable plastic and said means for hingedly joining said tab means comprises heat sealing.

9. The collapsible article carrier of claim 1 wherein said sheet of material comprises an extruded sheet of plastic and said means for hingedly joining said tab means comprises ultrasonic welding.

10. The collapsible article carrier of claim 1 wherein said predetermined angle of said end panel fold lines is approximately 45°.

11. A collapsible article carrier formed from a folded sheet of material and being alternatively foldable into a substantially flat position and an open position for receiving articles comprising:

a unitary bottom member having first and second bottom panels, said first and second bottom panels being hingedly joined along a central horizontal fold line a centrally disposed wall foldably joined to said first and second bottom panels along said cetral horizontal fold line;

first and second side walls parallel to one another and being hingedly joined along bottom edges thereof to edges of said first and second bottom panels opposite said central horizontal fold line of said unitary bottom member, such that said first and second side walls extend perpendicularly to said unitary bottom member when the collapsible article carrier is in the open position;

first and second end panels parallel to one another when the collapsible article carrier is in the open position, said first and second end panels being hingedly joined to opposed edges of said first side wall to extend perpendicularly to said first side wall when the collapsible article carrier is in the open position;

third and fourth end panels parallel to one another when the collapsible article carrier is in the open position, said third and fourth end panels being hingedly joined to opposed edges of said second side wall to extend perpendicularly to said second side wall and parallel to said first and second end panels when the collapsible article carrier is in the open position;

means for hingedly joining said first and third end panels to form a first end wall;

means for hingedly joining said second and fourth end panels to form a second end wall;

each of said end panels including a fold line having a predetermined angle with respect to the bottom edge of said end panels to permit said first and third end panels to lie coincident with one another and to permit said second and fourth end panels to lie coincident with one another when the collapsible article carrier is in the collapsed position;

means for attaching said unitary bottom member to said end panels including first and second tab means formed from first and second cutouts contained within said first bottom panel and means for hingedly joining said first and second tab means to said first and second end panels for securing said first bottom panel to said first and second end panels, and third and fourth tab means formed from third and fourth cutouts contained within said second bottom panel and means for hingedly joining said third and fourth tab means to said third and fourth end panels for securing said second bottom panel to said third and fourth end panels;

first and second dividing walls parallel to one another and perpendicularly disposed to said first and second side walls, said first and second dividing walls being hingedly joined to said first and second side walls at spaced locations between said first and second end walls to form with said centrally disposed wall a plurality of receiving cellular compartments between said first and second side walls within the collapsible article carrier; and said bottom member being foldable along said central horizontal fold line to fold upwardly and inwardly between said side walls in the collapsible article carrier collapsed position to thereby permit either one of said end walls to fold inwardly between said side walls, to thereby permit said side walls to lie coincident with one another in the collapsible article carrier collapsed position, such that the collapsible article carrier may be folded about said hinged panels and walls to a substantially flat collapsed position and foldable to the open position for receiving articles.

12. The collapsible article carrier of claim 11 wherein said first and second dividing walls include a centrally disposed vertical fold line, such that said first and second dividing walls lie parallel to said first and second side walls in the collapsible article carrier collapsed position.

13. The collapsible article carrier of claim 11 wherein said dividing walls extend substantially the entire length of the collapsible article carrier.

14. The collapsible article carrier of claim 11 and further including:

a handle member hingedly joined to said first and second end walls and including means for partitioning said plurality of receiving cellular compartments.

15. The collapsible article carrier of claim 14 wherein said means for partitioning said plurality of receiving cellular compartments extend substantially the entire height of the collapsible article carrier.

16. The collapsible article carrier of claim 11 wherein said panels and walls are hingedly joined along perforated fold lines.

17. The collapsible article carrier of claim 11 wherein said predetermined angle of said end panel fold lines is approximately 45°.

18. The collapsible article carrier of claim 11 wherein said predetermined angle of said end panel fold lines is approximately 22.5°.

19. A collapsible article carrier formed from a folded sheet of material and being alternatively foldable into a substantially flat collapsed position and an open position for receiving articles comprising:

a unitary bottom member having first and second bottom panels, said first and second bottom panels being hingedly joined along a central horizontal fold line, a centrally disposed wall foldably joined to said first and second bottom panels along said central horizontal fold line;

first and second side walls parallel to one another and being hingedly joined along bottom edges thereof to edges of said first and second bottom panels opposite said central horizontal fold line of said unitary bottom member, such that said first and second side walls extend perpendicularly to said unitary bottom member when the collapsible article carrier is in the open position;

first and second end panels parallel to one another when the collapsible article carrier is in the open position, said first and second end panels being hingedly joined to opposed edges of said first side wall to extend perpendicularly to said first side wall when the collapsible article carrier is in the open position;

third and fourth end panels parallel to one another when the collapsible article carrier is in the open position, said third and fourth end panels being hingedly joined to opposed edges of said second side wall to extend perpendicularly to said second side wall and parallel to said first and second end panels when the collapsible article carrier is in the open position;

means for hingedly joining said first and third end panels to form a first end wall;

means for hingedly joining said second and fourth end panels to form a second end wall;

each of said end panels including first and second fold lines having predetermined angles with respect to the bottom edge of said end panels to permit said first and third end panels to lie coincident with one another and to permit said second and fourth end panels to lie coincident with one another when the collapsible article carrier is in the collapsed position;

means for attaching said unitary bottom member to said end panels including first and second tab means formed from first and second cutouts contained within said first bottom panel and means for hingedly joining said first and second tab means to said first and second end panels for securing said first bottom panel to said first and second end panels, and third and fourth tab means formed from third and fourth cutouts contained within said second bottom panel and means for hingedly joining said third and fourth tab means to said third and fourth end panels for securing said second bottom panel to said third and fourth end panels;

first and second dividing walls parallel to one another and perpendicularly disposed to said first and second side walls, said first and second dividing walls including tab means for hingedly joining said first and second dividing walls to said first and second side walls at spaced locations between said first and second end walls to form with said centrally disposed wall a plurality of receiving cellular compartments between said first and second side walls within the collapsible article carrier;

said first and second dividing walls including a centrally disposed vertical fold line, such that said first and second dividing walls lie parallel to said first and second side walls in the collapsible article carrier collapsed position;

a handle member hingedly joined to said first and second end walls and including means for partitioning said plurality of receiving cellular compartments;

said handle member further including vertical slots disposed between said partitioning means for engaging said dividing walls along said centrally disposed vertical fold line; and said bottom member being foldable along said central horizontal fold line to fold upwardly and inwardly between said side walls in the collapsible article carrier collapsed position to thereby permit either one of said end walls to fold inwardly between said side walls, to thereby permit said side walls to lie coincident with one another in the collapsible article carrier collapsed position, such that the collapsible article carrier may be folded to a substantially flat collapsed position and folded to the open position for receiving articles.

20. The collapsible article carrier of claim 19 wherein said panels and walls are hingedly joined along perforated fold lines.

21. The collapsible article carrier of claim 19 wherein said sheet of material comprises an extruded sheet of plastic and said means for hingedly joining said tab means comprises ultrasonic welding.

22. The collapsible article carrier of claim 19 wherein said sheet of material comprises a heat sealable plastic and said means for hingedly joining said tab means comprises heat sealing.

23. The collapsible article carrier of claim 19 wherein said predetermined angles of said end panels first and second fold lines are approximately 45° and 22.5°.

24. In a collapsible article carrier having opposed end walls and opposed side walls formed from a folded sheet of material and being alternatively foldable into a substantially flat collapsed position and an open position for receiving articles, a bottom wall comprising:

a unitary bottom member having first and second bottom panels, said first and second bottom panels being hingedly joined along a central horizontal fold line;

said first and second bottom panels being hingedly joined at opposite edges thereof to the opposed side walls of the collapsible article carrier;

first and second tab means formed from first and second cutouts contained within said first bottom panel and means for hingedly joining said first and second tab means to the opposed end walls for securing said first bottom panel to the opposed end walls of the collapsible article carrier; and third and fourth tab means formed from third and fourth cutouts contained within said second bottom panel and means for hingedly joining said third and fourth tab means to the opposed end walls for securing said second bottom panel to the opposed end walls of the collapsible article carrier.

25. The bottom wall of claim 24 wherein said bottom panels and said centrally disposed wall are hingedly joined along fold lines including a plurality of apertures symmetrically spaced along said fold lines.

26. A collapsible article carrier formed from a folded sheet of material and being alternatively foldable into a substantially flat collapsed position and an open position for receiving articles and formed from two half sections which are hinged together, wherein each half section comprises:

a bottom member;

a side wall hingedly joined along an edge of said bottom member, such that said side wall extends perpendicularly to said bottom member when the collapsible article carrier is in the open position;

first and second end panels parallel to one another when the collapsible article carrier is in the open position, said first and second end panels being hingedly joined to opposite edges of said side wall to extend perpendicularly to said side wall when the collapsible article carrier is in the open position said first and second end panels each including a fold line having a predetermined angle with respect to the bottom edge of said end panels to permit said end panels to lie parallel to said side wall when the collapsible article carrier is in the collapsed position;

means for attaching said bottom member to said first and second end panels; and a handle member for joining said first and second end panels and for joining the half sections of the collapsible article carrier.

27. The collapsible article carrier of claim 26 wherein said means for attaching said bottom member to said first and second end panels includes:

first and second tab means formed from first and second cutouts contained within said bottom member and means for hingedly joining said first and second tab means to said first and second end panels.

* * * * *

UNITED STATES PATENT AND TRADEMARK OFFICE

CERTIFICATE OF CORRECTION

PATENT NO. :4,210,241

DATED :July 1, 1980

INVENTOR(S) :Paul J. Morcom

It is certified that error appears in the above-identified patent and that said Letters Patent are hereby corrected as shown below:

References cited: 2,284,682 to Powell, date should be 6/1942.

Col. 7, line 17, last occurrence of "and" should be --are--.

Col. 13, line 8, "length" should be --height--.

Signed and Sealed this

*Fourth* Day of *November 1980*

[SEAL]

*Attest:*

SIDNEY A. DIAMOND

*Attesting Officer*

*Commissioner of Patents and Trademarks*